United States Patent [19]

Carella

[11] Patent Number: 5,052,365

[45] Date of Patent: Oct. 1, 1991

[54] ARCHERY TRAINING DEVICE

[76] Inventor: Richard F. Carella, 35572 Strathcona Dr., Mt. Clemens, Mich. 48043

[21] Appl. No.: 432,794

[22] Filed: Nov. 6, 1989

Related U.S. Application Data

[63] Continuation-in-part of Ser. No. 58,395, Jun. 5, 1987, Pat. No. 4,909,232, and a continuation-in-part of Ser. No. 934,674, Nov. 25, 1986, Pat. No. 4,887,584, and a continuation-in-part of Ser. No. 891,863, Jul. 30, 1986, abandoned, and a continuation-in-part of Ser. No. 848,983, Apr. 7, 1986, abandoned.

[51] Int. Cl.[5] ..... F41B 5/00; A63B 21/02

[52] U.S. Cl. ..... 124/90; 124/88; 272/137; 272/143

[58] Field of Search ..... 124/86, 88, 20 R, 17, 124/90, 80, 23 R, 35 H, 22, 20 B, 20.1, 23.1, 35.2, 20.3; 272/141-143, 137, 135, 67, 68; 434/247, 258

[56] References Cited

U.S. PATENT DOCUMENTS

| | | | |
|---|---|---|---|
| 3,072,115 | 1/1963 | Johnson | 124/35 A |
| 3,462,142 | 8/1969 | Sterndale . | |
| 3,494,346 | 2/1970 | Yount et al. | 124/20 R |
| 3,749,075 | 7/1973 | Saunders | 124/20 R |
| 3,983,860 | 10/1976 | Bolton | 124/20 R |
| 4,026,549 | 5/1977 | Gunn . | |
| 4,041,926 | 8/1977 | Troncoso . | |
| 4,079,933 | 3/1978 | Everroad . | |
| 4,245,840 | 1/1981 | Van Housen . | |
| 4,279,601 | 7/1981 | Cobelli . | |
| 4,426,989 | 1/1984 | Sutton | 124/35 A |
| 4,441,707 | 4/1984 | Bosch . | |
| 4,489,705 | 12/1984 | Larson . | |
| 4,509,497 | 4/1985 | Garrison | 124/35 A |
| 4,609,191 | 9/1986 | Remme . | |
| 4,887,584 | 12/1989 | Carella | 124/88 X |

*Primary Examiner*—Peter M. Cuomo

*Attorney, Agent, or Firm*—Remy J. VanOphem

[57] ABSTRACT

An archery training device (10) is disclosed for teaching an archer proper upper body muscular control and positioning while shooting a bow (14). The archery training device (10) includes a string arm connector (18) having an upper loop (20) that is securable to the archer's string arm above the elbow (24). A lower loop (26) is securable to the string arm (22) below the elbow (24). The loops (20, 26) cooperate upon pulling the string arm connector (18) in relation to the bowstring (16) to prevent shifting of the string arm connector (18) with respect to the elbow (24) of the string arm (22). An elastomeric force carrying member (28) extends forwardly from the string arm connector (18) and is secured to the bowstring (16). The elastomeric force carrying member (28) is extendable between a relaxed configuration (30) prior to bowstring release and a stretched configuration (32) after bowstring release. The muscles associated with the archer's upper body function upon and after release of the bowstring (16) to restrain the bow hand (15), string arm (22), and shoulders (23, 25) from movement that would adversely affect shooting accuracy.

21 Claims, 5 Drawing Sheets

ARCHERY TRAINING DEVICE

CROSS-REFERENCE TO RELATED APPLICATIONS

This application is a continuation-in-part of prior co-pending application Ser. No. 058,395 filed June 5, 1987, now U.S. Pat. No. 4,909,232; and prior application Ser. Nos. 934,674 filed Nov. 25, 1986, now U.S. Pat. No. 4,887,584; 891,863 filed July 30, 1986, now abandoned and 848,983 filed Apr. 7, 1986, now abandoned.

BACKGROUND OF THE INVENTION

1. Field of the Invention

This invention relates to an archery training device for teaching an archer proper muscular control and body positioning before, during, and after string release for accurate shooting of a bow without an arrow.

2. DESCRIPTION OF THE PRIOR ART

An observer of an archer shooting a bow and arrow occasionally witnesses a flinching or collapsing of the archer's upper body immediately prior to releasing the bowstring. Such body movement results in inconsistent and inaccurate shooting. Its cause is attributable to the archer having relaxed upper back muscles so that the bow hand, string arm, or shoulders begin to move before the string fingers are free of the bowstring.

The period during which the upper back muscles relax before the fingers are free of the bowstring has been termed "reflex muscle relax time." This period begins when the string fingers start to open and ends when they are free of the forward pull exerted by the bowstring.

"Target panic" is another term used to describe what happens during the reflex muscle relax time. It denotes the involuntary response exhibited by the archer's upper body back muscles. "Target panic" becomes developed in all seasoned archers and is attributable to sound and sight. Often, the archer will begin to shoot the shot before the arrow is correctly aimed by sight, or he will anticipate the sound of a draw clicker and relax his rear upper body muscles prematurely.

In general, the shorter the "reflex muscle relax time," the less adverse movement will there be for the archer's bow arm, string arm, and shoulders. Consequently, he or she will shoot more consistently and accurately.

The importance of an archer practicing every day to improve his skills has led to a need for training devices that can be used safely without injury to the archer or persons nearby. It would be desirable to provide a device which can be used without an arrow, thereby enabling practicing to occur without damaging equipment or bystanders. Additionally, it would be useful if such a device could be used indoors, between shots at a tournament, or while hunting in order to keep muscles correctly stretched and toned.

Archery training devices have been disclosed, for example, in U.S. Pat. No. 4,609,191 which issued to Remme on Sept. 2, 1986. This reference, however, is not used with a bow or a bowstring.

SUMMARY OF THE INVENTION

After over 30 years of being involved in the sport of archery and the study of muscle anatomy in relationship thereto, I have invented an archery training device for teaching an archer proper upper body muscular control and positioning while shooting a bow without an arrow. The device includes a string arm connector which has an upper loop securable to the upper arm of the archer's string arm proximate the elbow. Also included in the string arm connector is a lower loop which is securable to the forearm of the archer's string arm, also close to the elbow. Together, the loops cooperate upon pulling the string arm connector to prevent shifting thereof about the elbow of the string arm.

An elastomeric force carrying member extends forwardly from the string arm connector and is secured to the bowstring. The elastomeric force carrying member is extendable between a relaxed configuration prior to bowstring release and a stretched configuration after bowstring release.

The archery training device provides the archer feedback about his position and reflex muscle relax time after the bowstring release. The feedback is based on an imbalance of forces exerted by upper back muscles which causes adverse movement of the bow arm, string arm, and shoulders or an incorrect positioning of the elastomeric force carrying member where it moves away from the side of the neck, thus adversely affecting shooting accuracy.

I have discovered that there are three keys to consistent and accurate shooting. One is to position the archer's bow hand, string arm, and shoulders so that they are co-planar. In a full draw position, each of these body points ideally should be located on a single plane which I have termed a "rigid frame plane." An archer properly positioned on the rigid frame plane during the reflex muscle relax time will reduce movement of the bow hand, string arm, and shoulders in a manner which will improve shooting accuracy.

The second key is to keep the correct upper back muscle forces working upon and after release of the bowstring by the string fingers and to shorten the reflex muscle relax time. The third key is to reduce movement of the bow hand, string arm, and shoulders, thus improving shooting accuracy. After the bow is fully drawn and correctly aimed, the archer releases the bowstring. During the release, the elastomeric force carrying member extends between a full draw position and a released position. The extension produces a tensile force that is transmitted to the muscles of the bow arm, the string arm, the shoulders, back, and most of the upper body framework. The tensile force transmitted by the elastomeric force carrying member between the bow hand and string hand requires the upper back muscles to continue to push and pull throughout the shot, thus training the rear upper body muscles by repeated exercise to shorten reflex muscle relax time.

By repeated use of the archery training device, the archer's rear upper body develops a "muscle memory" of the shortened reflex muscle relax time which enables him to shoot this shortened reflex without the training device. Continuous feedback of the elastomeric force carrying member's position to the rigid frame plane trains the archer to duplicate this correct position without the training device during actual shooting.

The tensile force exerted by the elastomeric force member counteracts the bow force during the release. This tensile force substitutes for the weight of the arrow and prevents the bow from being damaged.

The objects, features, and advantages of the present invention are readily apparent from the following detailed description of the best modes for carrying out the invention when taken in connection with the accompanying drawings.

DETAILED DESCRIPTION OF THE PREFERRED EMBODIMENT

Figure 1:
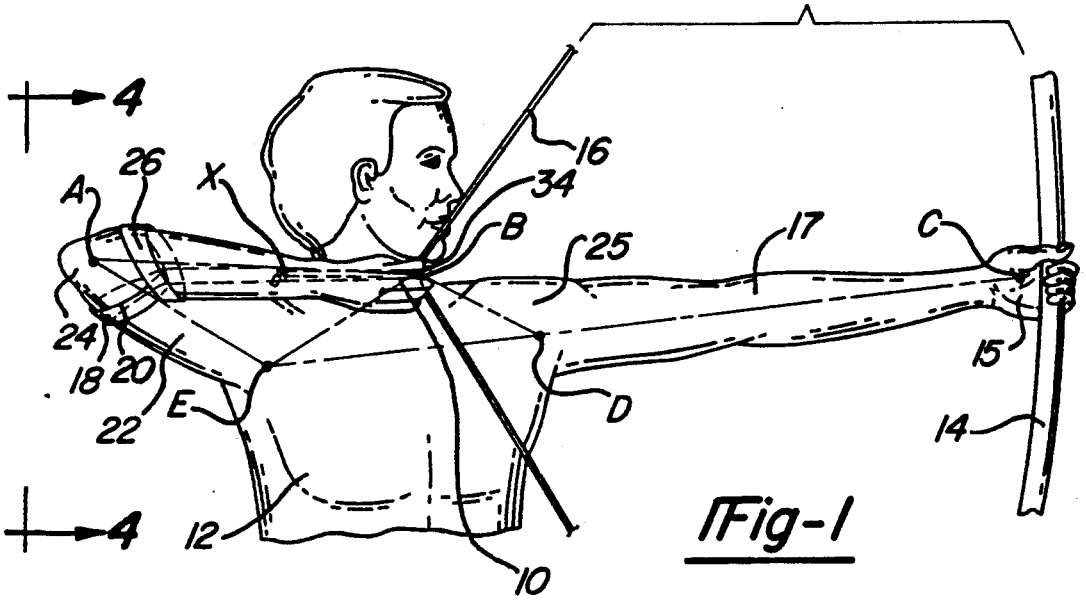
FIG. 1 is a side view of an archery training device that is used with an archery bow in a full draw configuration, the device being constructed in accordance with the present invention.
Figure 2:
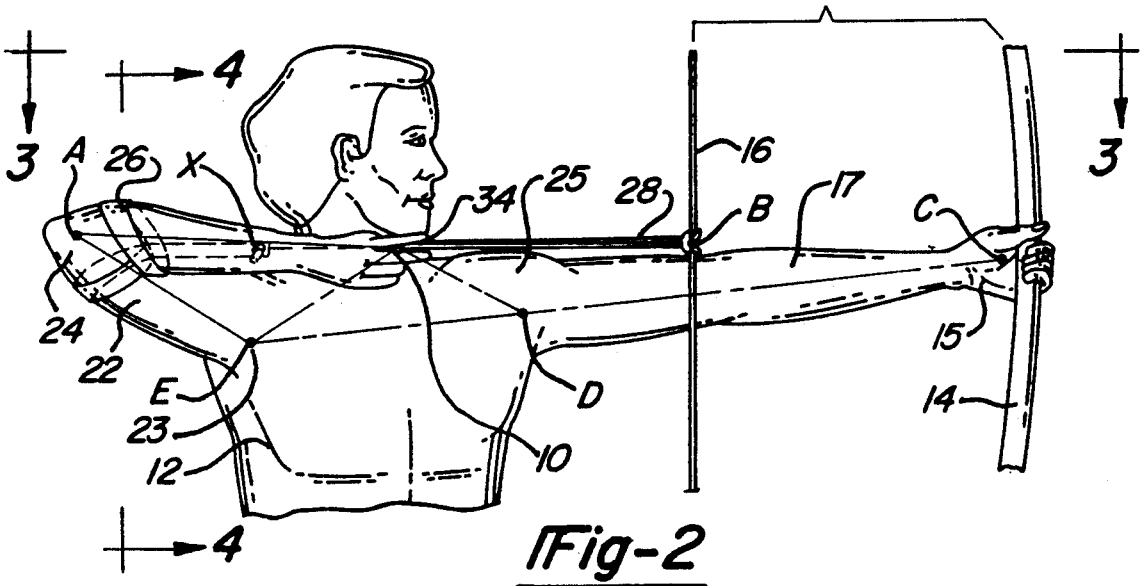
FIG. 2 is a side view of the archery training device constructed in accordance with the present invention, including a string arm connector and an elastomeric force carrying member, shown in a released configuration after bowstring release.
Figure 3:
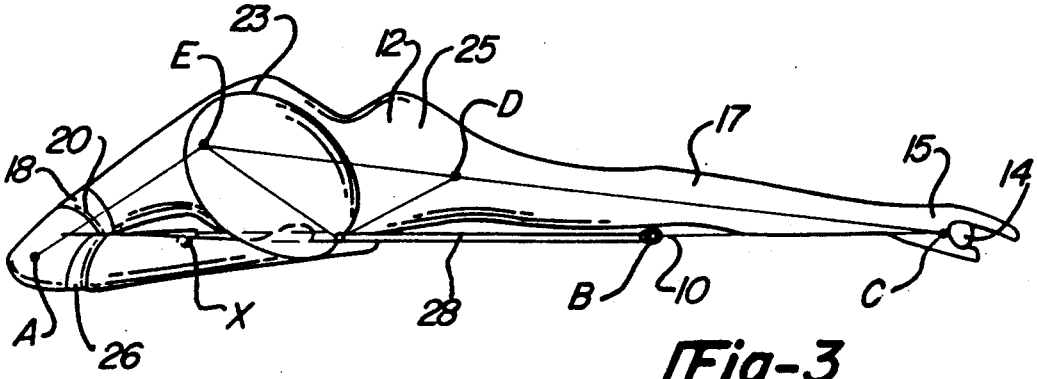
FIG. 3 is a top view of the archery training device in the released configuration after bowstring release taken along the line 3—3 of FIG. 2.

One embodiment of an archery training device constructed in accordance with the present invention is identified generally by reference numeral 10 in FIG. 1 and is further illustrated in FIGS. 2-3 The archery training device 10 is used for teaching an archer 12 proper upper body muscular control and positioning while shooting a bow 14 including a bowstring 16.

The archery training device 10 includes a string arm connector 18 including an upper loop 20 which is securable to the upper arm of the archer's string arm 22 proximate his elbow 24. Also included in the string arm connector 18 is a lower loop 26 which is securable to the forearm of the archer's string arm 22 proximate his elbow 24. Together, the loops 20, 26 cooperate upon pulling the string arm connector 18 to prevent shifting thereof about the elbow 24 of the string arm 22, thereby avoiding unwanted shifting of the archery training device 10 and promoting operational safety.

An elastomeric force carrying member 28 extends forwardly from the string arm connector 18 and is secured to the bowstring 16. Together, FIGS. 1 and 2 illustrate that the elastomeric force carrying member 28 is extendable between a full draw configuration prior to bowstring release (FIG. 1) and a released configuration after bowstring release (FIG. 2). Upon and after bowstring release, the muscles associated with the upper back restrain the archer's bow hand 15, string arm 22, and shoulders 23, 25 from movement that would adversely affect shooting accuracy.

Figure 4:
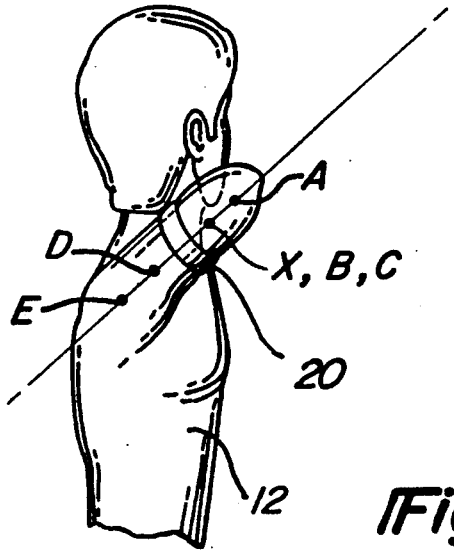
FIG. 4 is a rear view of an archer using the archery training device of the present invention taken along the line 4—4 of FIGS. 1 and 2, and showing a "rigid frame plane"

An understanding of the concept that resulted in the development of the archery training device 10 is facilitated by the collective views of FIGS. 1-4. In FIG. 4, for example, there is a rear view illustrating a "rigid frame plane." In FIGS. 1-4, the following reference alphabetic terminology is used;

| Reference Letter | Denoting |
|---|---|
| A | String arm elbow 24 |
| B | Anchor or arrow nocking point 34 of bow string by string fingers |
| C | Contact point 15 of bow by bow hand |
| D | Front shoulder joint 25 |
| E | Rear shoulder joint 23 |

Turning now with primary reference to FIG. 4, the "rigid frame plane" concept involves aligning points A-E of the archer's upper body in a single plane. For best accuracy and consistency in shooting, I have discovered that the anchor hand ("B"), the rear elbow joint ("A"), the contact ("C") of the bow hand to bow handle, and the front and rear shoulder joints ("D" and "E") should be co-planar on the rigid frame plane in the full draw position. When points A-E are positioned so that they are co-planar, bow forces do not move the bow hand or string hand as much from the intended trajectory of the arrow during the reflex muscle relax time.

If not aligned in a co-planar relationship the bow hand 15 and/or the string hand and string hand fingers 34 tend to move further away from the intended trajectory during the reflex muscle relax time, thereby adversely affecting shooting accuracy. Even a small amount of movement caused by a resultant force due to the string elbow being below the rigid frame plane will tend to move the bow hand away from the archer's neck during the reflex muscle relax time, thus causing inaccuracy in shooting.

Figure 7:
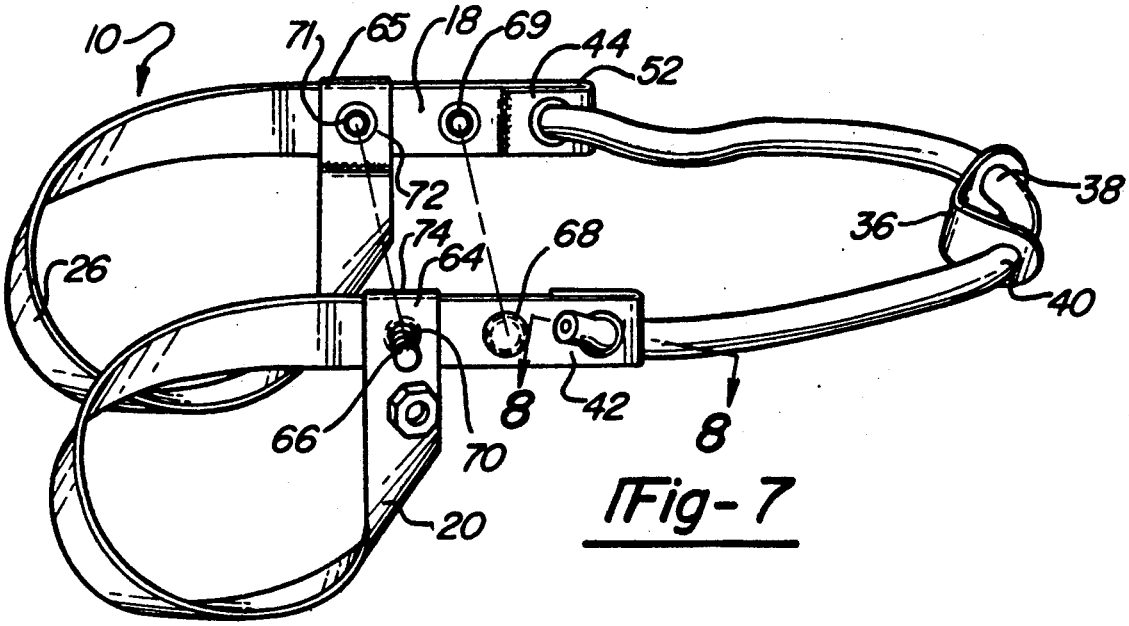
FIG. 7 is a perspective view of an embodiment of the archery device constructed in accordance with the present invention which includes a guard and fasteners.
Figure 8:
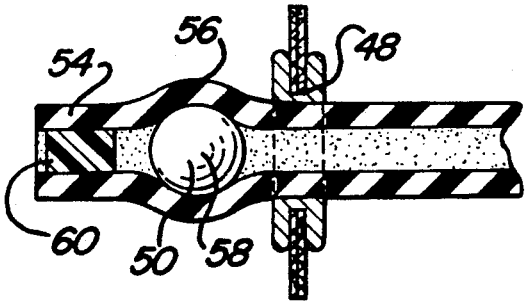
FIG. 8 a sectional view of a portion of an embodiment of the archery training device constructed in accordance with the present invention taken along the line 8—8 of FIG. 7.
Figure 9:
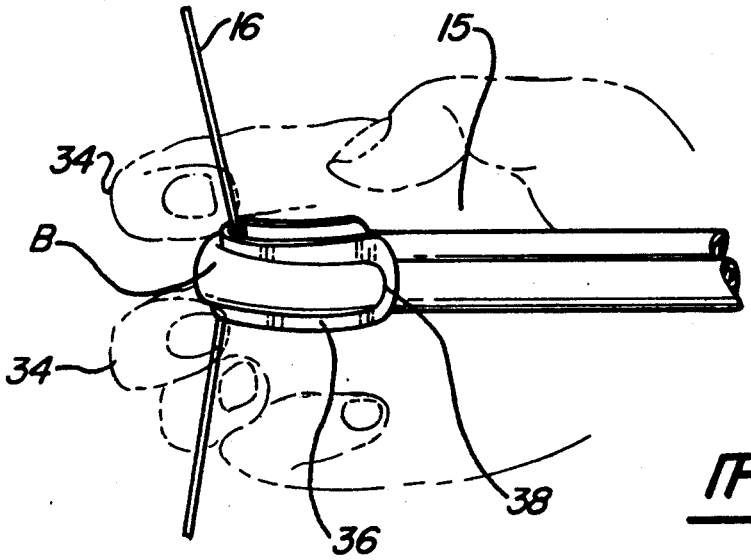
FIG. 9 is a perspective view of a portion of one embodiment of the archery training device constructed in accordance with the present invention illustrating the guard, the bowstring, and the elastomeric force carrying member.

Turning now to FIGS. 7-9, there is depicted a preferred construction of the archery training device 10, which includes a guard portion 36. Positioned between the elastomeric force carrying member 28 and the bowstring 16, the guard portion 36 protects the elastomeric force carrying member 28 from the bowstring 16. In practice, the guard portion 36 may be made of leather, or fabricated from a plastic-like material. The guard portion 36 defines a pair of apertures 38, 40 which receive the elastomeric force carrying member 28.

Figure 5:
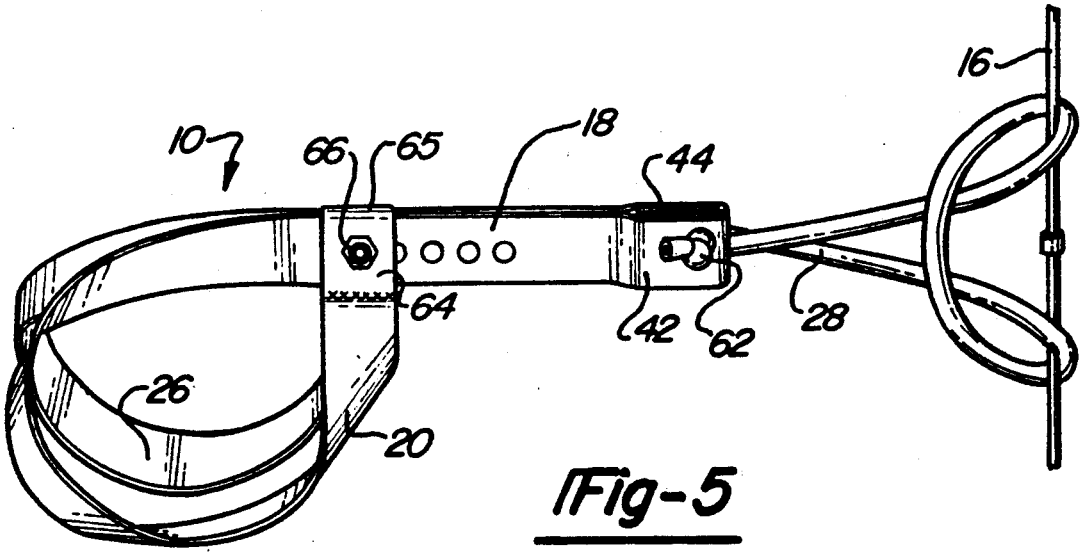
FIG. 5 is a side view of one embodiment of the archery training device constructed in accordance with the present invention illustrating an adjuster for accommodating the string arm connector to the size of the archer's arm.
Figure 6:
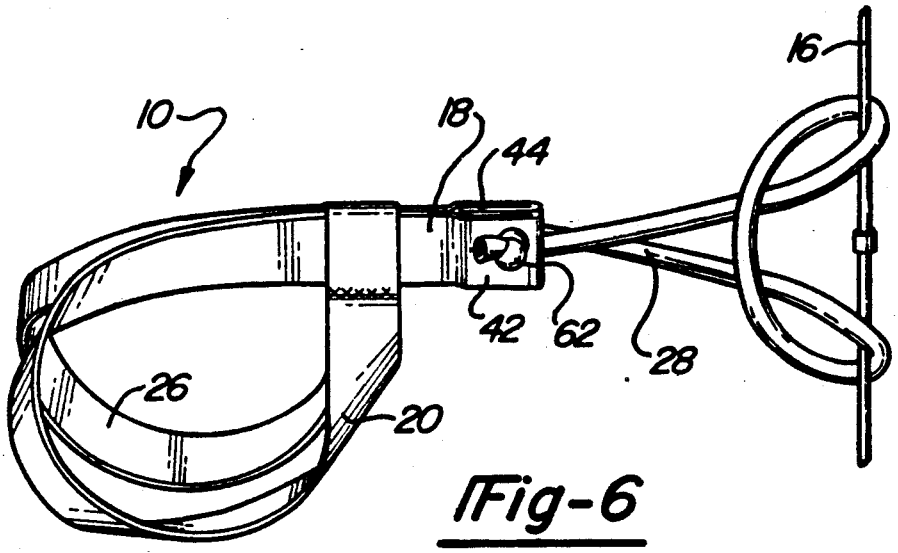
FIG. 6 is a side view of an embodiment of the archery training device constructed in accordance with the present invention, in which loops associated with the string arm connector are fixed in length.

Turning now to FIGS. 5-7, it is apparent that the archery training device 10 includes a pair of linking members 42, 44 which extend from the loops 20, 26 for connection to the elastomeric force carrying member 28. Each linking member 42, 44 includes a grommet 46, 48 (shown in FIG. 10) through which the elastomeric force carrying member 28 extends.

As best shown in FIGS. 5–9, the elastomeric force carrying member 28 is elongate and tubular. A pair of stops 50, 52 are inserted within the tubular ends 54 of the elastomeric force carrying member 28. The stops 50, 52 cooperate with the tubular ends 54 of the elastomeric force carrying member 28 to define enlarged portions 56. Each enlarged portion 56 interferes with the associated grommet 46, 48 so that when the archer pulls the elastomeric force carrying member 28, the tubular ends 54 are secured for safety.

Alternate embodiments of the archery training device 10 include a ball 58 serving as the stop 50, as shown in FIG. 8. Alternatively, either or both of the stops 50, 52 may include a plug 60. In the embodiment depicted in FIG. 8, the stop 50 comprises a ball 58 proximate the grommet 48 and the plug 60. In practice, good results have been obtained when a sealing compound is used to secure each form of stop within the enlarged portion 56 of the tubular end 54.

Turning back to FIGS. 5–6, there is depicted an embodiment of the elastomeric force carrying member 28 wherein each of the stops 50, 52 is a knot 62 which is formed proximate an end of the elongate elastomeric force carrying member 28.

As is best seen in FIG. 7, each loop 20 26 includes a closed segment 64, 65 through which the associated linking member 42, 44 passes. In contrast the embodiment depicted in FIG. 5 illustrates the passage of an adjuster 66 through both closed segments 64, 65. It will readily be appreciated that, as depicted in FIG. 7, each loop 20, 26 may be capable of individual adjustment by the passage of an adjuster through the associated linking member 42, 44 and closed segment 64, 65. In this way, the archery training device 10 can be readily customized to accommodate an archer having a relatively bulky upper arm, but a relatively small girth of associated forearm, or visa versa.

There has been disclosed with particular reference to FIG. 5 an embodiment of the archery training device 10 wherein the loops 20, 26 are adjustable together by one adjuster 66 which passes through the closed segments 64, 65 and the associated linking members 42, 44.

Continuing with reference to FIG. 7, the preferred embodiment of the archery training device 10 includes a first fastener 68, 69 attached to the linking members 42, 44 for detachably retaining each loop 20, 26 together upon application of forces associated with shooting. The first fastener 68, 69 allows separation of the loops 20, 26 during assembly and disassembly of the archery training device 10.

As can readily be appreciated by primary reference to FIG. 7, the archery training device 10 is used by leading the elastomeric force carrying member 28 around the bowstring 16, attaching the upper loop 20 to the string arm 22 above the elbow 24, and attaching the lower loop 26 to the archer's forearm below the elbow 24. Next, the loops are fastened together using the first fastener 68, 69.

In operation, the archer draws the bow 14 to the full draw position (FIG. 1) without an arrow. When the archer has correctly aimed, he releases the bowstring 16. During the release, the elastomeric force carrying member 28 is stretched from the full draw position (FIG. 1) to the released position (FIGS. 2 and 3). This stretching produces a force that is transferred to the string arm 22, the bow arm 17, and the remaining parts of the entire upper body framework. Forces exerted on the upper body by the elastomeric force carrying member 28 in transitioning between the full draw 30 and released 32 positions require (shown in FIG. 11 and 12) the archer to push and pull his upper body muscles so that they work throughout the duration of the shot. This minimizes the reflex muscle relax time as defined earlier, and improves both the accuracy and consistency of shooting with repeated practice.

Referring again to FIG. 7, it can readilly be appreciated that an embodiment of the archery training device 10 includes a second fastener 70, 71 which is attached to the closed segments 64, 65 of the associated loops 20, 26. As shown, each second fastener 70, 71 includes, for example, male and female portions of a press-stud. The male and female portions are respectively mounted on inner-facing portions 72 of the closed segments 64, 65 so that they are engageable to detachably retain the closed segments 64, 65 together. Adjoining the inner-facing portion 72 of each closed segment is an outer-facing portion 74. To provide adjustability for each loop a conventional fastener, such as a nut and bolt extends through the associated linking member 42 and outer-facing portion 74.

Alternate embodiments of the archery training device 10 respectively include a first fastener 68, a second fastener 70, or both fasteners 68, 70.

Figure 10:
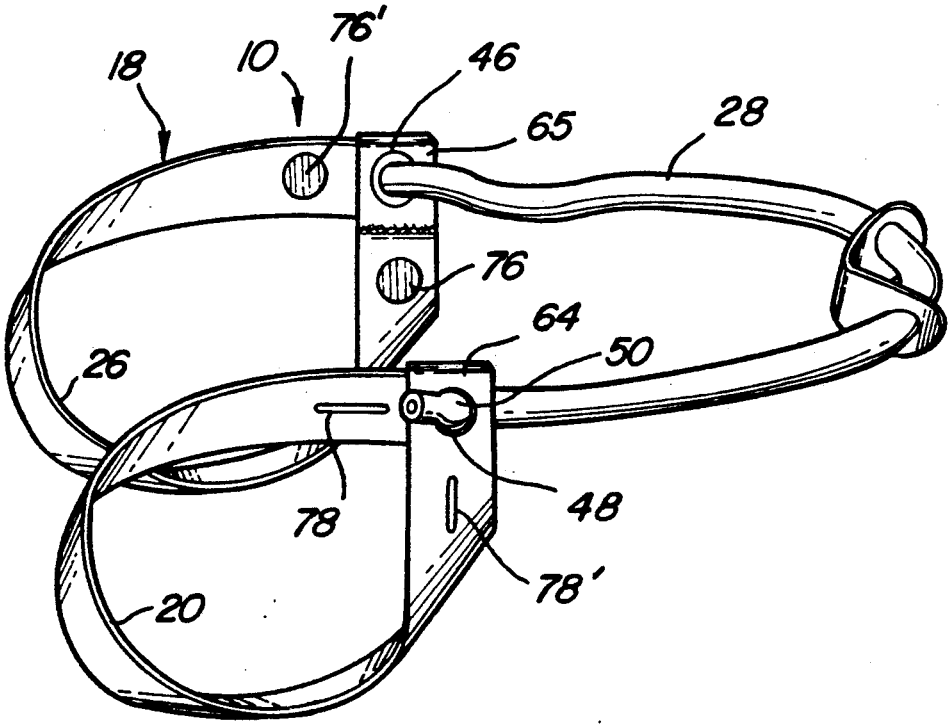
FIG. 10 is a perspective view of another embodiment of the archery training device constructed in accordance with the present invention illustrating the use and alternate positioning of another type of fastener.

With primary reference to FIG. 10, there is depicted a further embodiment of the invention wherein each loop 20, 26 includes a closed segment 64, 65 through which the associated loop passes. Extending through each closed segment 64, 65 and loop is a grommet 48, 46. The grommets 48, 46 secure the loops 20, 26 to the elastomeric force carrying member 28. Each of the loops 26, 20 also includes a pair of fasteners 76, 76', 78, 78' which are mounted proximate the associated grommets 46, 48 for detachably retaining each loop 26, 20 together proximate the elbow of the string arm upon application of forces associated with shooting. The fasteners 76, 76' and 78, 78' also allow joinder of the loops 26, 20 during assembly of the archery training device 10, while allowing the loops 26, 20 to be separated during its disassembly. Good results have been obtained where the fasteners 76, 78 constitute a stud and a slit for receiving the stud. In practice, pivot bachelor buttons are well suited for this purpose. To assemble such buttons, a pivot is inserted through the loop where the stud 76 is to be placed. Next, the pivot is inserted into a shank defined in the button and is struck straight-on to lock the button in place.

Continuing with reference to FIG. 10, it will readily be appreciated that the fasteners 76, 76' and 78, 78' serve not only to join the loops 26, 20 together after assembly so that the string arm connector fits securely adjacent the elbow of the string arm, but may also be adapted to adjust the length of the loops 26, 20 to accommodate the needs of archers having differently sized string arms. For example, the more distant the fasteners 76, 78 are from the grommets 46 and 48, the smaller will be the spacing available to accommodate the associated loops 26, 20 to the archer's string arm. Similar comments are applicable to the positioning of fasteners 76', 78' relative to the grommets.

Figure 11:
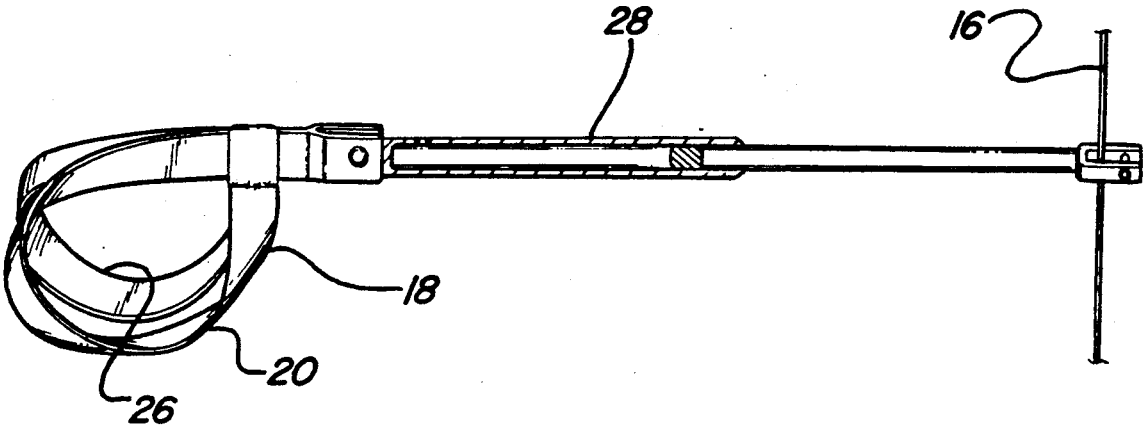
FIG. 11 is a side view of another embodiment of the archery training device constructed in accordance with the present invention illustrating an alternative for the resilient means employed between the string arm connector and the bowstring, in a fully extended positon.
Figure 12:
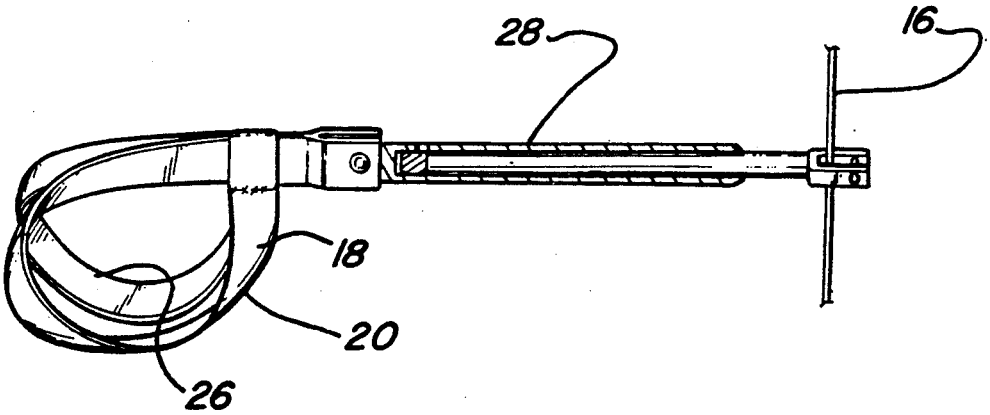
FIG. 12 is a side view of the archery training device as shown in FIG. 11 in a fully retracted positon.

Good results have been achieved when the elastomeric force carrying member 28 is made of latex tubing. Alternatively, a spring or an hydraulic cylinder may be used as an elastomeric force carrying member 28, as shown in FIG. 11 and FIG. 12.

By repeated use of the archery training device 10, the archer is aided in developing a perfect shot. This is characterized by co-planar movement of the points A–E (FIG. 4) from the beginning of bowstring release to the point at which bow forces are dissipated. Thus, repeated practice by the archery training device 10 teaches the archer proper upper body rear muscular control and body positioning for accurate shooting in a manner that was not heretofore possible.

While the best modes for carrying out the invention have been described in detail, those familiar with the art to which this invention relates will recognize various alternative designs and embodiments for carrying out the invention as defined by the following claims.

What is claimed is:

1. An archery training device for teaching an archer proper upper body muscular control and positioning while shooting a bow including a bowstring, said archery training device comprising:

a string arm connector having an upper loop securable to the upper arm of the archer's string arm proximate the elbow and a lower loop securable to the forearm of the archer's string arm proximate the elbow, said upper and lower loops cooperating together upon pulling the string arm connector to prevent shifting thereof about the elbow of the string arm; and a resilient force carrying means having one end attached to said string arm connector and an opposite end extending in a direction away from said string arm connector, said opposite end of said resilient force carrying means having means for attaching said resilient force carrying means to said bowstring such that when said archery training device is mounted to the archer's string arm by securing the upper loop to the upper portion of the string arm and the lower loop to the lower portion of the string arm and said resilient force carrying means is attached to said bowstring and said bowstring is drawn to the full draw position said resilient force carrying means is at a relaxed configuration prior to bowstring release and a stretched configuration after bowstring release, whereby the muscles associated with the upper body continue to work during and after release of the bowstring by the string fingers to restrain the archer's bow hand, string arm and shoulders from movement that would adversely affect shooting accuracy, such that said archery training device provides to said archer positional feedback based on such movement, said feedback relating to a co-planar alignment of said archer's bow hand, string arm and shoulders upon bowstring release.

2. The archery training device as claimed in claim 1, further comprising:

a guard portion positoned between said resilient force carrying means and said bowstring for protectng said resilient force carrying means from said bowstring.

3. The archery training device as claimed in claim 2, wherein said guard portion further comprises a pair of apertures therein, said pair of apertures receiving therethrough said resilient force carrying means.

4. The archery training device as claimed in claim 1, further comprising:

a pair of linking members, one each of said pair of linking members extending from each asid upper and lower loops for connecting each of said upper and lower loops, respectively, to said resilient force carrying means.

5. The archery training device as claimed in claim 4, wherein each said linking member of said pair of linking members includes a grommet to which said resilient force carrying means is attached.

6. The archery training device as claimed in claim 5, wherein said resilient force carrying means is an elongated and tubular elastomeric member having one end and an opposite end, and wherein said archery training device further comprises:

a pair of stops, one of said pair of stops being inserted in said one end of said elastomeric member, the other of said pair of stops being in said opposite end of said elastomeric member, each of said pair of stops cooperating with its respective end to define enlarged portions, such that when each of said ends are attached to one of said upper and lower loops said enlarged portions interfere with said grommets so that when the archer pulls said resilient force carrying means, each of said ends is secured by said associated grommet.

7. The archery training device as claimed in claim 6, wherein each of said stops of said pair of stops comprises a spherical member.

8. The archery training device as defined in claim 6, wherein each of said stops of said pair of stops comprises a plug.

9. The archery training device as claimed in claim 6, wherein each of said stops of said pair of stops comprises a spherical member and a plug.

10. The archery training device as claimed in claim 6, wherein each of said stops of said pair of stops comprises a knot formed proximate an end of said elongated and tubular elastomeric member.

11. The archery training device as claimed in claim 4, wherein each of said upper and lower loops includes a closed segment through which the associated linking member passes and wherein said string arm connector further comprises at least one adjuster which extends through at least one closed segment and said associated linking member, said upper and lower loops further having lengths which are altered by said at least one adjuster to accommodate the archer's arm so that they are sized to approximate the girth of the archer's string arm proximate said elbow thereof, said upper and lower loops fitting said string arm thereat to avoid shifting of said string arm connector in relation to said elbow when said archery training device is under tension.

12. The archery training device as claimed in claim 11, further including a first fastener attached to each said linking member for detachably retaining one of said upper and lower loops together upon applicaiton of forces associated with shooting and allowing separation of said upper and lower loops during assembly and disassembly of asid archery training device.

13. The archery training device as claimed in claim 11, further including a second fastener attached to each closed segment of said upper and lower loops for detachably retaining each loop together upon application of forces associated with shooting and allowing separation of said upper and lower loops during assembly and disassembly of said archery training device.

14. The archery training device as claimed in claim 11, further including a first fastener attached to each linking member and a second fastener attached to each closed segment of said upper and lower loop, said first and second fasteners detachably retaining each said upper and lower loops together upon application of forces associated with shooting and allowing separation of said upper and lower loops during assembly and disassembly of said archery training device.

15. The archery training device as claimed in claim 4, wherein each of said upper and lower loops includes a closed segment having an inner face adjoining an outer face, each of said pair of linking members passing between its associated inner and outer face and wherein said string arm connector further comprises an adjuster associated with said outer face of each closed segment, said adjuster extending through said outer face of said closed segment and associated linking member, each of said upper and lower loops being adjustable by cooperation between each of said respective one of said adjuster, said outer face of asid closed segment, and said associated linking member, said upper and lower loops having a length which is altered by said respective adjuster to accommodate the archer's arm so that each said upper and lower loop is sized to approximate the girth of the archer's string arm proximate said elbow thereof, said upper and lower loop cooperating together and fitting said elbow of said string arm to avoid shifting of said string arm connector in relation to said elbow when said archery training device is under tension.

16. The archery training device as claimed in claim 15, further comprising a second fastener attached to each of said inner faces of said closed segments for detachably retaining said respective upper and lower loops together for assembly and disassembly of said archery training device.

17. The archery training device as claimed in claim 1, wherein said resilient force carrying means comprises latex tubing.

18. The archery training device as claimed in claim 1, wherein said resilient force carrying means comprises a spring.

19. The archery training device as claimed in claim 1, wherein asid resilient force carrying means comprises an hydraulic cylinder.

20. The archery training device as claimed in claim 1, wherein each of said upper and lower loops include a closed segmeent through which said associated loop passes and a grommet which extends through said closed segment and said associated loop for securement of each said upper and lower loop to said resilient force carrying means, each of said upper and lower loops further including a pair of fasteners mounted proximate an associated grommet for detachably retaining each of said upper and lower loops together proximate said elbow of said string arm upon application of forces associated with shooting, for allowing joinder of said upper and lower loops during assembly, and for separation of said upper and lower loops during disassembly of said archery training device.

21. The archery training devices as claimed in claim 20, wherein each fastener of said pairs of fasteners comprises a stud in one of said upper and lower loops and a slit defined in the other of said upper and lower loops for receiving said stud.

* * * * *

UNITED STATES PATENT AND TRADEMARK OFFICE

CERTIFICATE OF CORRECTION

PATENT NO. : 5,052,365

DATED : October 1, 1991

INVENTOR(S) : Richard F. Carella

It is certified that error appears in the above-identified patent and that said Letters Patent is hereby corrected as shown below:

Column 2, line 17, delete "musc.les" and insert ---- muscles ----.

Column 3, line 1, after "OF" insert ---- THE ----.

Column 3, line 58 delete "2-3 The" and insert ---- 2-3. The ----.

Column 5, line 19, delete "comprises" and insert ---- is ----.

Column 5, line 29, delete "20 26" and insert ---- 20, 26 ----.

Column 5, line 31, after "contrast" insert ---- , ----.

Column 6, line 12, delete "readilly" and insert ---- readily ----.

Column 6, line 23, after "loop" insert ---- , ----.

Column 6, line 24, after "bolt" insert ---- , ----.

Column 6, line 37, delete "76'," and insert ---- 76' and ----.

Column 8, line 2, delete "asid" and insert ---- said ----.

Column 8, line 29, delete "defined" and insert ---- claimed ----.

Column 8, line 56, delete "applicaiton" and insert ---- application ----.

Column 8, line 59, delete "asid" and insert ---- said ----.

UNITED STATES PATENT AND TRADEMARK OFFICE

CERTIFICATE OF CORRECTION

PATENT NO. : 5,052,365

DATED : October 1, 1991

INVENTOR(S) : Richard F. Carella

It is certified that error appears in the above-identified patent and that said Letters Patent is hereby corrected as shown below:

Column 9, line 19, delete "asid" and insert ---- said ----.

Column 10, line 10, delete "asid" and insert ---- said ----.

Column 10, line 14, delete "segmeent" and insert ---- segment ----.

Column 10, line 27, delete "devices" and insert ---- device ----.

Signed and Sealed this

Second Day of February, 1993

*Attest:*

*Attesting Officer*

STEPHEN G. KUNIN

*Acting Commissioner of Patents and Trademarks*